US008662902B1

(12) United States Patent
Lai

(10) Patent No.: US 8,662,902 B1
(45) Date of Patent: Mar. 4, 2014

(54) SWIVEL CABLE CONNECTOR MOUNTING STRUCTURE

(75) Inventor: Chyi-Lang Lai, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 1 day.

(21) Appl. No.: 13/620,129

(22) Filed: Sep. 14, 2012

(51) Int. Cl.
*H01R 39/00* (2006.01)

(52) U.S. Cl.
USPC ..... 439/13

(58) Field of Classification Search
USPC ..... 439/13, 17–18, 31, 638–649, 535–538, 439/131, 502
See application file for complete search history.

(56) References Cited

U.S. PATENT DOCUMENTS

| | | | | |
|---|---|---|---|---|
| 5,834,696 | A * | 11/1998 | Kurosawa et al. | 174/84 C |
| 6,390,845 | B1 * | 5/2002 | Brady | 439/372 |
| 6,742,221 | B2 * | 6/2004 | Lu et al. | 16/367 |
| 7,665,927 | B2 * | 2/2010 | Bosley et al. | 403/135 |
| 8,157,569 | B1 * | 4/2012 | Liu | 439/11 |
| 8,500,492 | B2 * | 8/2013 | Brown et al. | 439/638 |
| 2008/0194119 | A1 * | 8/2008 | Mori | 439/13 |
| 2010/0151698 | A1 * | 6/2010 | Cheng | 439/13 |
| 2010/0151699 | A1 * | 6/2010 | Cho | 439/13 |
| 2011/0207340 | A1 * | 8/2011 | Cairns | 439/18 |
| 2012/0196455 | A1 * | 8/2012 | Fisher | 439/13 |

* cited by examiner

*Primary Examiner* — Jean F Duverne
(74) *Attorney, Agent, or Firm* — Muncy, Geissler, Olds & Lowe, P.C.

(57) ABSTRACT

A swivel cable connector mounting structure includes a device housing having a through hole at a peripheral wall thereof, a rotary connector including a cylindrical base rotatably inserted through the through hole, two metal pivot rods affixed to an outer coupling end of the cylindrical base outside the device housing and two metal conducting terminals embedded in an inner end of the cylindrical base and respectively connected to the two metal pivot rods, a spring member mounted around the rotary connector and stopped between the peripheral wall of the device housing and a part of the cylindrical base of the rotary connector, a swivel connector including a U-shaped base pivotally coupled to the two metal pivot rods and two metal conductors embedded in the U-shaped base and kept in positive contact with the two metal pivot rods, and an electrical cable electrically connected to the two metal conductors.

7 Claims, 7 Drawing Sheets

SWIVEL CABLE CONNECTOR MOUNTING STRUCTURE

BACKGROUND OF THE INVENTION

1. Field of the Invention

The present invention relates to the arrangement of an electrical cable of an electronic device and more particularly, to a swivel cable connector mounting structure, which allows the electrical cable to be biased in X-axis and Y-axis directions, avoiding breaking wire conductors and contact failures.

2. Description of the Related Art

Following fast development of the modern technology and electronic industry, many different kinds of consumer electronics such as computer, notebook computer, PDA (personal digital assistant), cell phone and other computer peripheral devices are created, bringing convenience to people. In the recent years, the electronic products have a tendency toward light, thin, short and small and a variety of functions. In order to minimize the device dimension, internal components for electronic devices must be made having the characteristics of small size, high precision and high durability.

FIGS. 6 and 7 illustrate two different conventional designs of power supply devices for notebook computer. These two designs of power supply devices commonly comprise a transformer B, a power input cable A having its one end electrically connected to an input side of the transformer B and its other end terminating in an electric plug A1, and a power output cable C extended out of the output side of the transformer B for power output to an internal power circuit of a notebook computer. In the aforesaid two different conventional designs of power supply devices, the proximal end C1 of the power output cable C extends out of the peripheral wall of the transformer B at 90° or 180° angle. During application, the proximal end C1 of the power output cable C may be stretched accidentally by an external stretching force, resulting in broken wires or contact failures, or leading to disasters.

Therefore, it is desirable to provide a measure that eliminates the aforesaid problem.

SUMMARY OF THE INVENTION

The present invention has been accomplished under the circumstances in view. It is therefore the main object of the present invention to provide a swivel cable connector mounting structure, which eliminates the drawbacks of the aforesaid prior art notebook computer power supply devices.

According to one aspect of the present invention, the swivel cable connector mounting structure comprises a device housing having a through hole at a peripheral wall thereof, a rotary connector, which comprises a cylindrical base rotatably inserted through the through hole of the device housing, two metal pivot rods affixed to an outer coupling end of the cylindrical base outside the device housing and two metal conducting terminals embedded in an inner end of the cylindrical base and respectively connected to the two metal pivot rods, a spring member mounted around the rotary connector and stopped between the peripheral wall of the device housing and a stop flange at the periphery of the cylindrical base of the rotary connector, a swivel connector, which comprises a U-shaped base pivotally coupled to the two metal pivot rods of the rotary connector and two metal conductors embedded in the U-shaped base and kept in positive contact with the two metal pivot rods of the rotary connector, and an electrical cable electrically connected to the two metal conductors.

Thus, the swivel connector can be turned about the metal pivot rods of the rotary connector between a horizontal position in line with the rotary connector and a vertical position perpendicular to the rotary connector. When the swivel connector is in the vertical position, the flattened outer coupling end of the electrically insulative cylindrical base is received in the device housing and the electrically insulative and substantially U-shaped base of the swivel connector is kept in close contact with the outer surface of the peripheral wall of the device housing. On the contrary, when the swivel connector is turned from the vertical position to the horizontal position, the round ends of the two bottom arms will be forced against the outer surface of the peripheral wall of the device housing to pull the flattened outer coupling end of the electrically insulative cylindrical base out of the through hole of the device housing.

DETAILED DESCRIPTION OF THE PREFERRED EMBODIMENT

Figure 1:
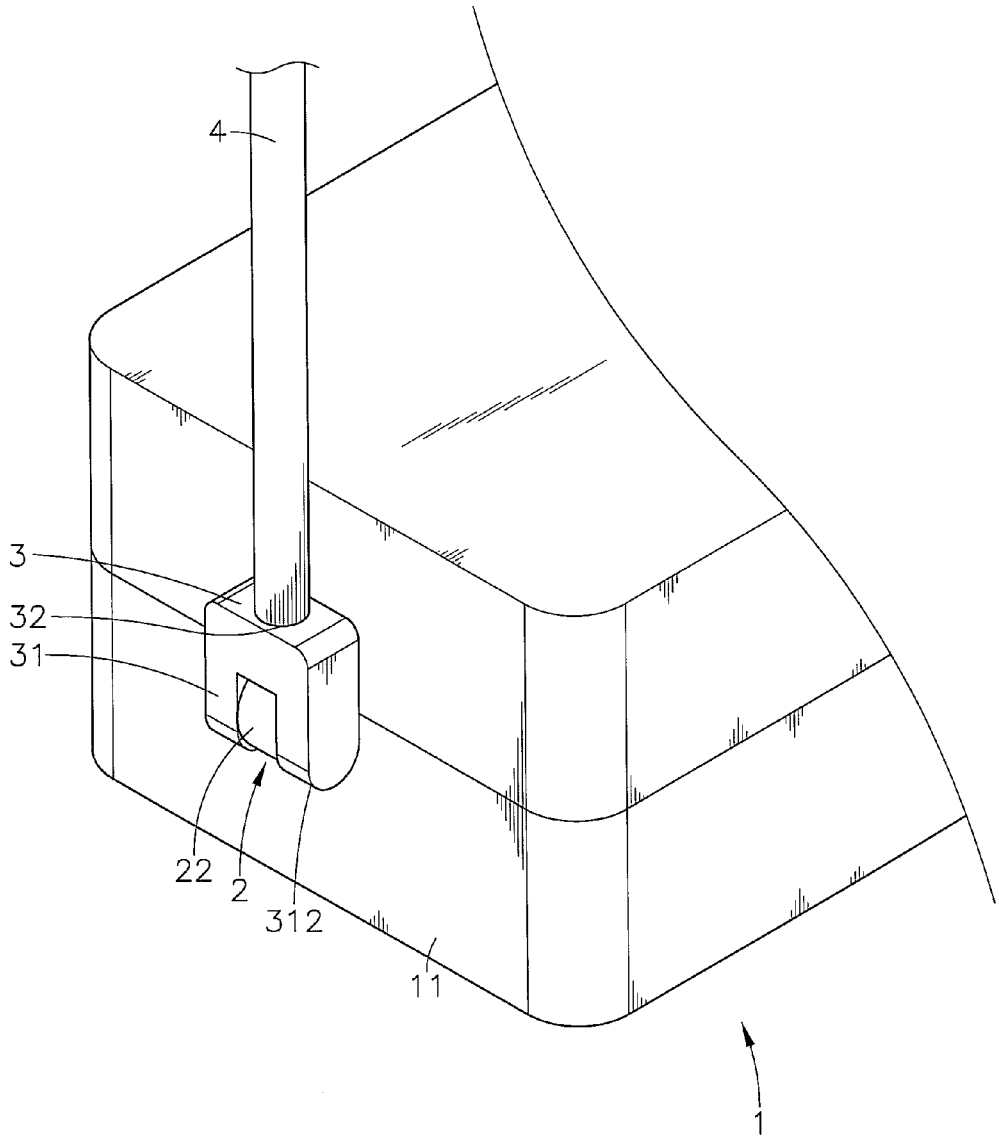
FIG. 1 is an elevational view of a swivel cable connector mounting structure in accordance with a first embodiment of the present invention.
Figure 2:
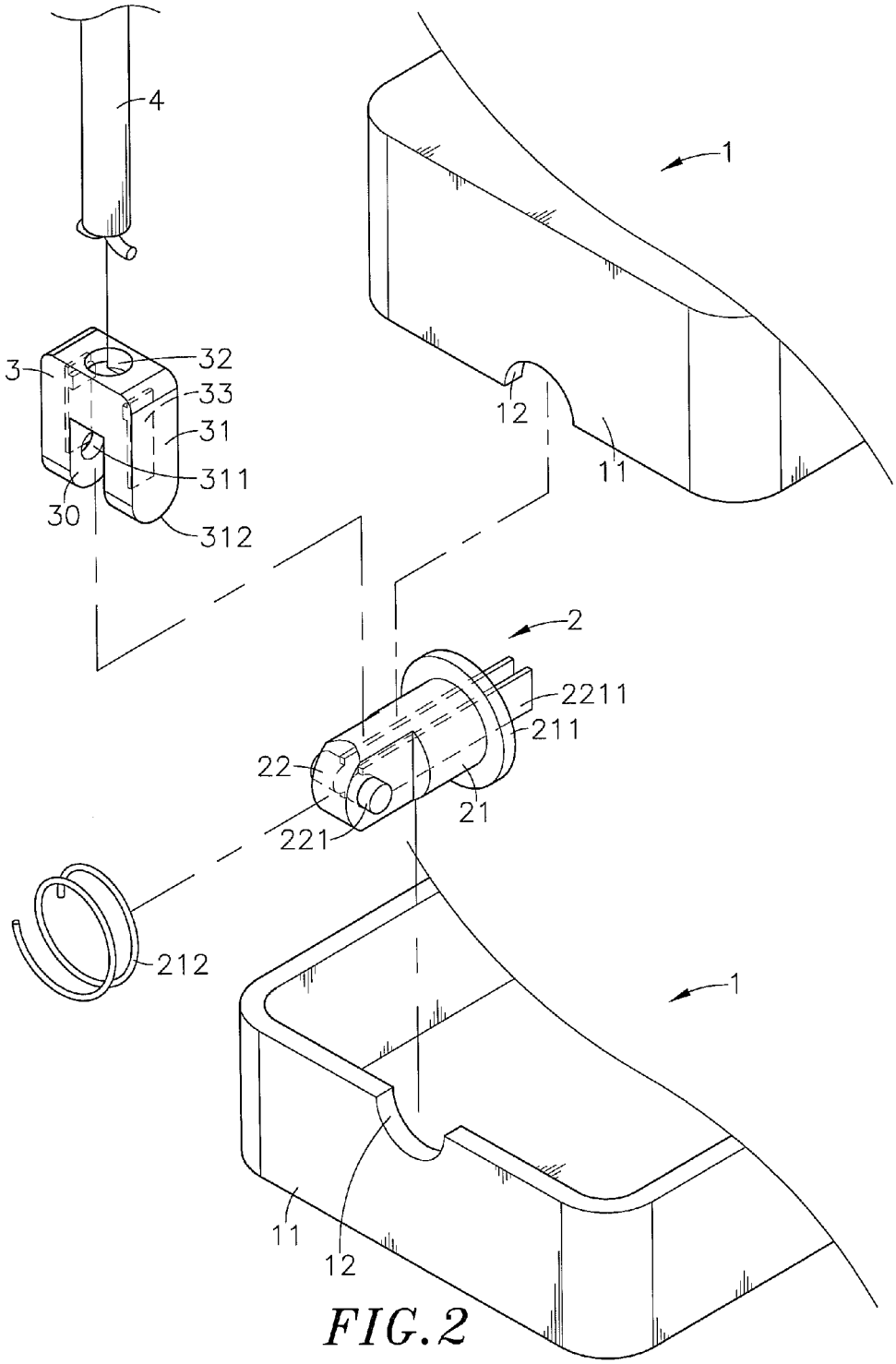
FIG. 2 is an exploded view of the swivel cable connector in accordance with the first embodiment of the present invention.
Figure 3:
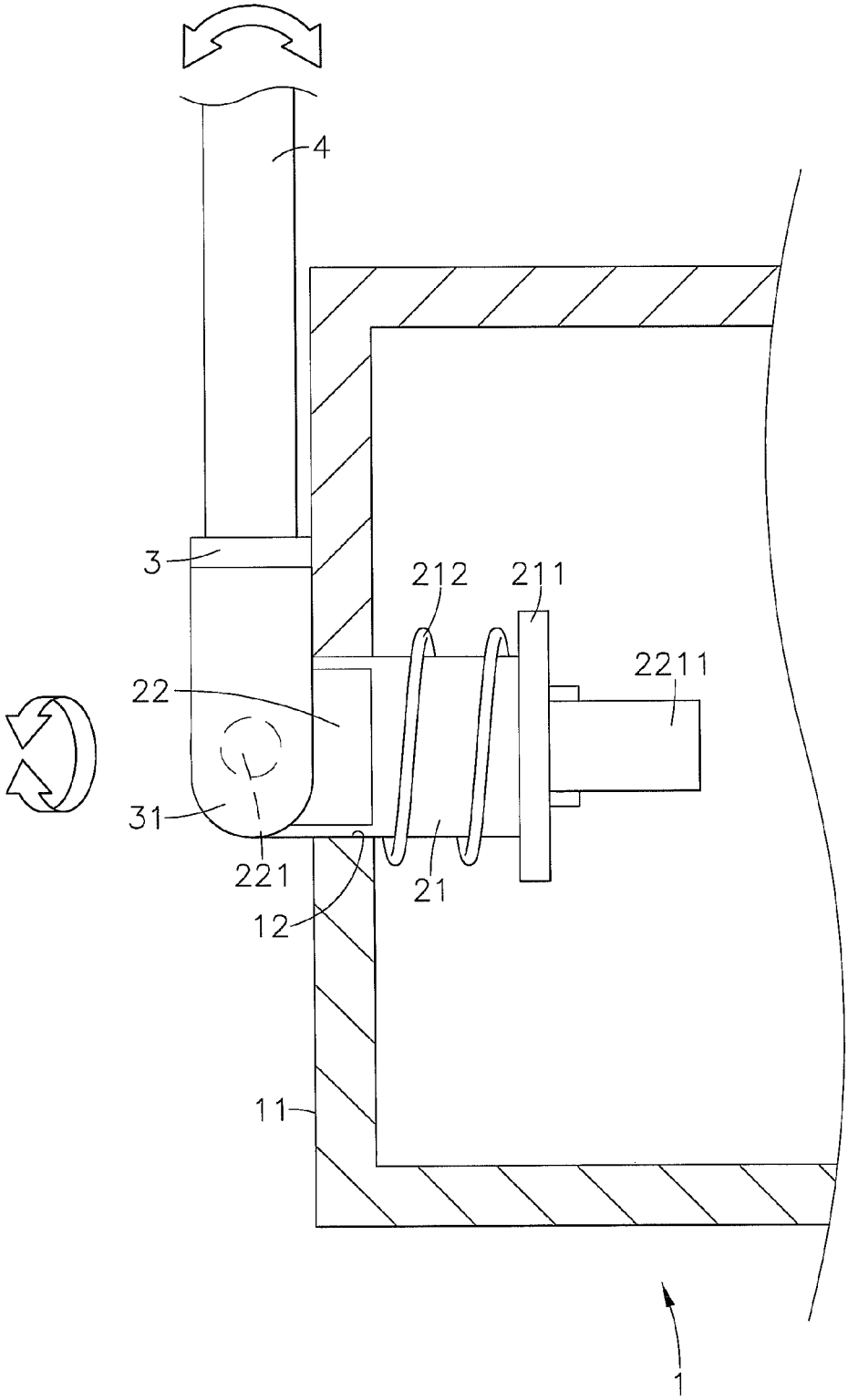
FIG. 3 is a schematic drawing of the first embodiment of the present invention, illustrating the swivel connector biasable in X-axis direction relative to the rotary connector and the rotary connector biasable in Y-axis direction relative to the device housing.
Figure 4:
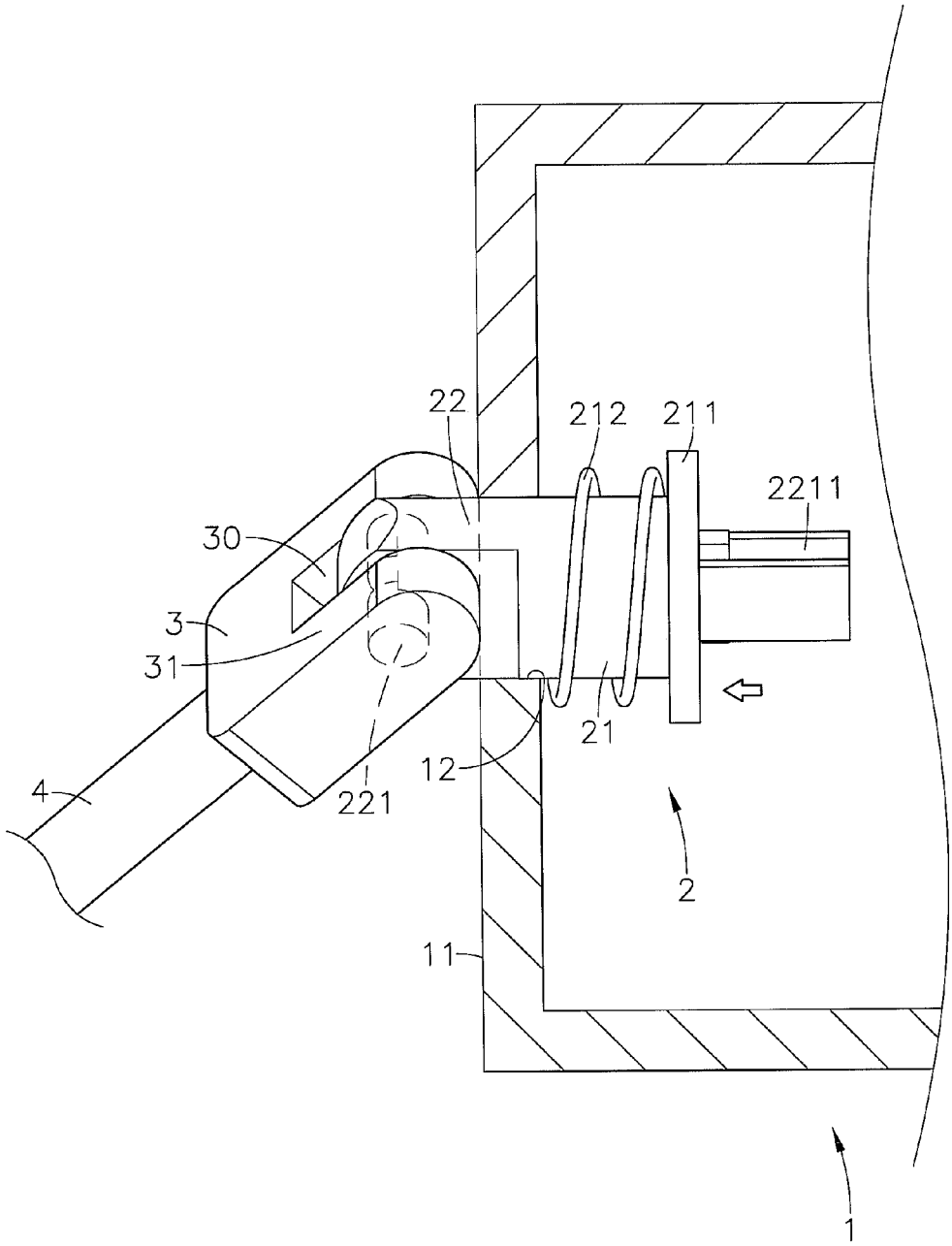
FIG. 4 is a schematic drawing of the first embodiment of the present invention, illustrating the rotary connector turned with the electrical cable about the pivot rods of the rotary connector.

Referring to FIGS. 1-4, a swivel cable connector mounting structure in accordance with a first embodiment of the present invention is shown. The swivel cable connector mounting structure comprises a device housing 1, a rotary connector 2, a spring member 212, a swivel connector 3, and an electrical cable 4.

The device housing 1 comprises an outmost shell of an electronic device, for example, power supply device, comprising a through hole 12 on one peripheral wall 11 thereof.

The rotary connector 2 comprises an electrically insulative cylindrical base 21 rotatably inserted through the through hole 12 of the device housing 1 and having an electrically insulative stop flange 211 extending around the periphery of an inner end thereof and suspending inside the device housing 1 and a flattened outer coupling end 22, two metal pivot rods 221 affixed to and bilaterally perpendicularly disposed at the flattened outer coupling end 22 of the electrically insulative cylindrical base 21 outside the device housing 1, and two metal conducting terminals 2211 longitudinally embedded in the electrically insulative cylindrical base 21 and respectively connected to the two metal pivot rods 221 at the flattened outer coupling end 22 of the electrically insulative cylindrical base 21 and respectively partially extending out of the inner end of the electrically insulative cylindrical base 21 in the device housing 1. The flattened outer coupling end 22 exhibits an elevational difference relative to the electrically insulative cylindrical base 21. Further, the electrically insulative stop flange 211 has a diameter greater than that of the through hole 12 of the device housing 1. Thus, the electrically insulative cylindrical base 21 can be moved axially relative to the through hole 12 of the device housing 1 within a limited range and will not fall out of the device housing 1.

The spring member 212 is a coil spring mounted around the electrically insulative cylindrical base 21 and stopped between the electrically insulative stop flange 211 of the electrically insulative cylindrical base 21 and the inner surface of the peripheral wall 11 of the device housing 1 to impart a pressure to the electrically insulative stop flange 211 of the electrically insulative cylindrical base 21 in direction toward the inside of the device housing 1.

The swivel connector 3 comprises an electrically insulative and substantially U-shaped base 31 having two round-end bottom arms 312 arranged in parallel, a coupling space 30 defined between the two round-end bottom arms 312 and configured to fit the flattened opposite outer end of the electrically insulative cylindrical base 21 of the rotary connector 2, a wire hole 32 located on a top side of the electrically insulative and substantially U-shaped base 31 in communication with the coupling space 30 and extending in a parallel manner relative to the extending direction of the two round-end bottom arms 312, two pivot holes 311 respectively transversely located on the two round-end bottom arms 312 in communication with the coupling space 30 and respectively pivotally coupled to the two metal pivot rods 221 at the flattened outer coupling end 22 of the electrically insulative cylindrical base of the rotary connector 2, and two metal conductors 33 embedded in the electrically insulative and substantially U-shaped base 31 and respectively extended to the pivot holes 311. The two metal conductors 33 are respectively kept in positive contact with the two metal pivot rods 221 of the rotary connector 2 after coupling between the pivot holes 311 and the metal pivot rods 221.

The electrical cable 4 is inserted through the wire hole 32 of the swivel connector 3 and electrically connected (with the positive pole and negative pole wire conductors thereof) to the two metal conductors 33.

When the electrical cable 4 is stretched by an external force in any particular direction during application, the rotary connector 2 can be rotated in the through hole 12 of the device housing 1, and the electrically insulative and substantially U-shaped base 31 of the swivel connector 3 can be turned about the metal pivot rods 221 at the flattened outer coupling end 22 of the electrically insulative cylindrical base 21 of the rotary connector 2, i.e., the electrical cable 4 can be biased in X-axis and Y-axis directions, avoiding breaking wire conductors and contact failures.

Further, the metal pivot rods 221 and metal conducting terminals 2211 of the rotary connector 2 can be separately made and then affixed to the electrically insulative cylindrical base 21. Alternatively, the metal pivot rods 221 and metal conducting terminals 2211 of the rotary connector 2 can be integrally embedded in the electrically insulative cylindrical base 21 using insert molding technology.

Further, as stated above, the spring member 212 is mounted around the electrically insulative cylindrical base 21 and stopped between the electrically insulative stop flange 211 of the electrically insulative cylindrical base 21 and the inner surface of the peripheral wall 11 of the device housing 1 to impart a pressure to the electrically insulative stop flange 211 of the electrically insulative cylindrical base 21 in direction toward the inside of the device housing 1. When the swivel connector 3 is turned about the metal pivot rods 221 of the rotary connector 2 from a horizontal position in line with the rotary connector 2 to a vertical position perpendicular to the rotary connector 2, subject to the effect of the spring member 212 to push the electrically insulative stop flange 211 of the electrically insulative cylindrical base 21 toward the inside of the device housing 1, the flattened outer coupling end 22 of the electrically insulative cylindrical base 21 is received in the device housing 1 and the electrically insulative and substantially U-shaped base 31 of the swivel connector 3 is kept in close contact with the outer surface of the peripheral wall 11 of the device housing 1. On the contrary, when turning the swivel connector 3 about the metal pivot rods 221 at the flattened outer coupling end 22 of the electrically insulative cylindrical base 21 of the rotary connector 2 from the vertical position back to the horizontal position, the round ends of the two round-end bottom arms 312 of the electrically insulative and substantially U-shaped base 31 will be forced against the outer surface of the peripheral wall 11 of the device housing 1 to pull the flattened outer coupling end 22 of the electrically insulative cylindrical base 21 out of the through hole 12 of the device housing 1.

Further, during application of the present invention, electric power from an external power source can be transmitted through the electrical cable 4, the two metal conductors 33 of the swivel connector 3, the metal pivot rods 221 of the rotary connector 2 and then the metal conducting terminals 2211 to an electric module (not shown) inside the device housing 1.

Figure 5:
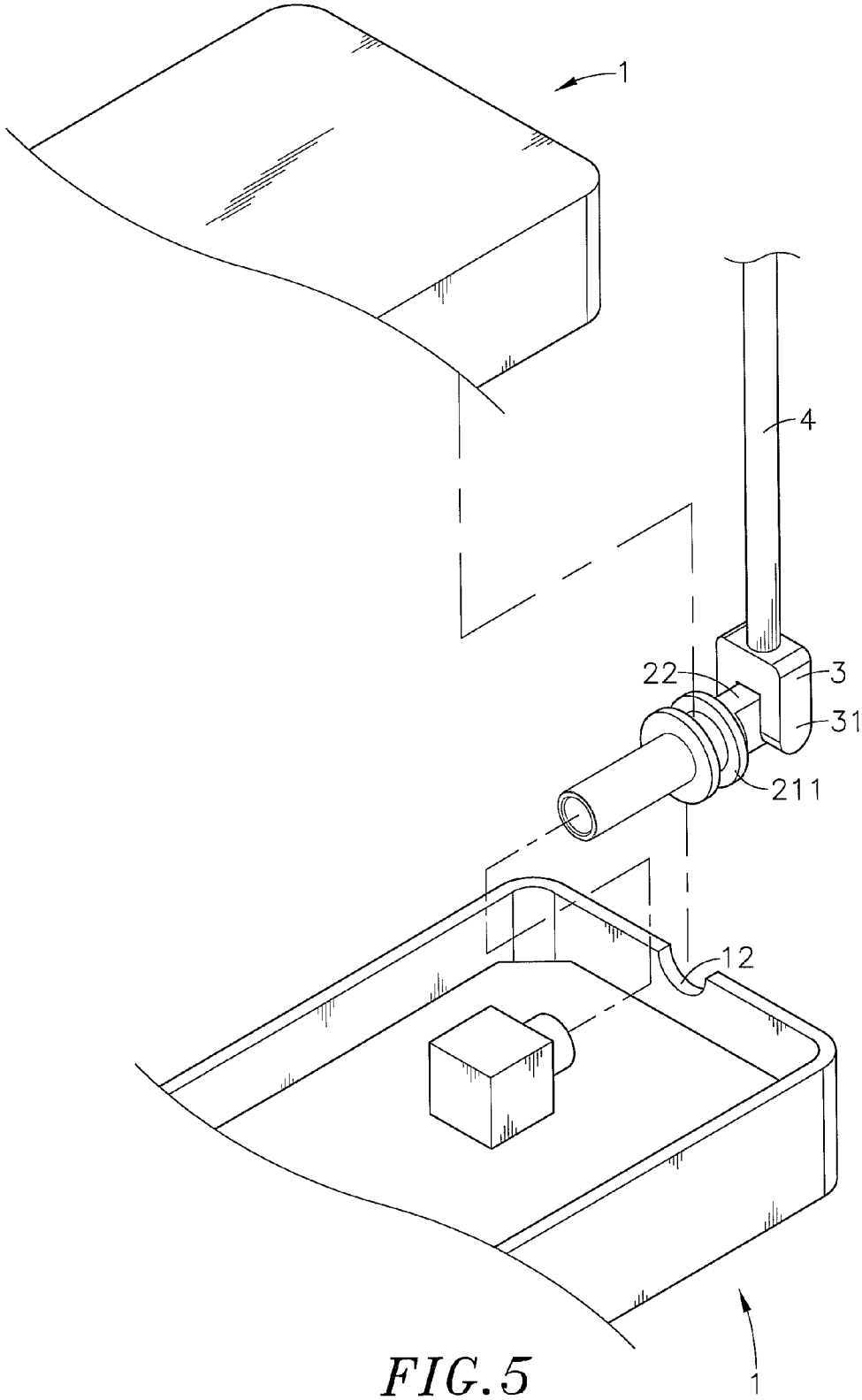
FIG. 5 is an exploded view of a swivel cable connector mounting structure in accordance with a second embodiment of the present invention.
Figure 6:
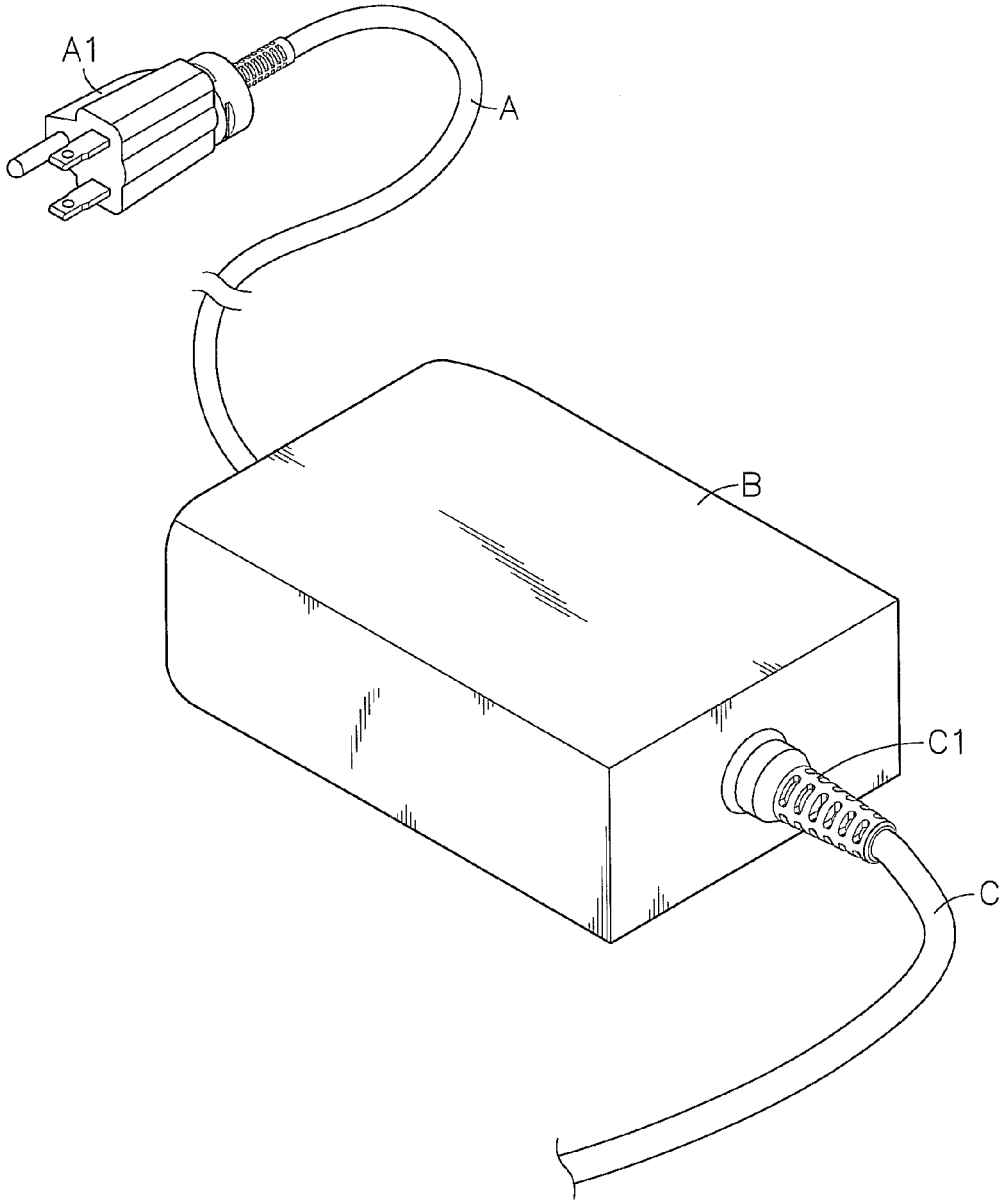
PRIOR ART FIG. 6
FIG. 6 is an elevational view of a power supply device for notebook computer according to the prior art.
Figure 7:
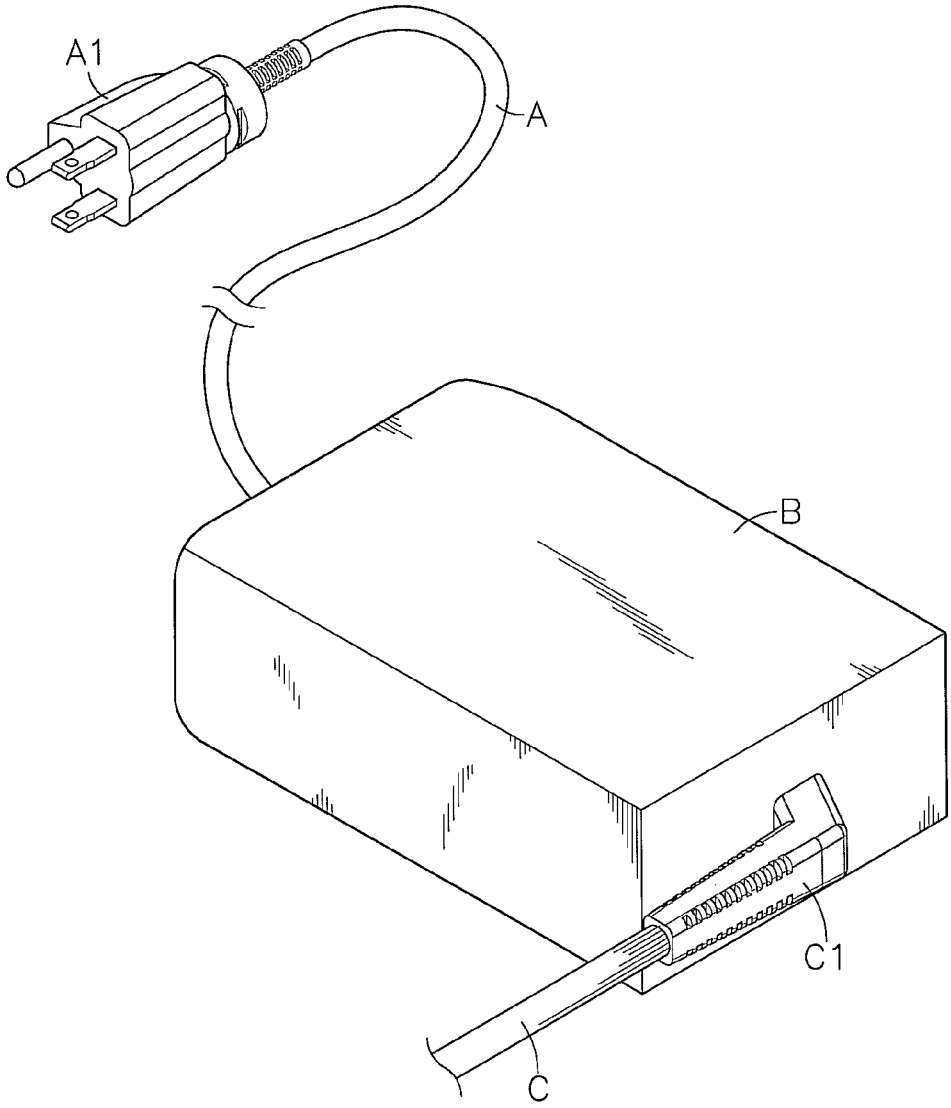
PRIOR ART FIG. 7
FIG. 7 is an elevational view of another design of power supply device for notebook computer according to the prior art.

FIG. 5 illustrates a swivel cable connector mounting structure in accordance with a second embodiment of the present invention. This second embodiment is substantially similar to the aforesaid first embodiment with the exception that the aforesaid spring member 212 is eliminated and, the electrically insulative cylindrical base 21 of the rotary connector 2 comprises two electrically insulative stop flanges 211 extending around the periphery thereof and respectively stopped at the inner and outer surfaces of the peripheral wall 11 of the device housing 1 (please see also FIG. 2). This second embodiment allows the rotary connector 2 to be rotated in the through hole 12 of the peripheral wall 11 of the device housing 1; however, it prohibits the rotary connector 2 from axial movement relative to the peripheral wall 11 of the device housing 1. Further, the metal conducting terminals 2211 of the aforesaid first embodiment are made in the form of flat metal blades; the metal conducting terminals 2211 of the second embodiment are made in the form of round contact pins.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A swivel cable connector mounting structure, comprising:

a device housing comprising a through hole at a peripheral wall thereof;

a rotary connector comprising an electrically insulative cylindrical base rotatably inserted through said through hole of said device housing, said electrically insulative cylindrical base having an inner end and an outer coupling end, two metal pivot rods affixed to and bilaterally perpendicularly disposed at said outer coupling end of said electrically insulative cylindrical base outside said device housing, and two metal conducting terminals longitudinally embedded in said electrically insulative cylindrical base and respectively connected to said two metal pivot rods and respectively partially extending out of the inner end of said electrically insulative cylindrical base in said device housing;

a swivel connector comprising an electrically insulative and substantially U-shaped base, said electrically insulative and substantially U-shaped base comprising two bottom arms arranged in parallel, a coupling space defined between said two bottom arms and configured to fit said opposite outer end of said electrically insulative cylindrical base of said rotary connector, and two pivot holes respectively transversely located on said two bottom arms in communication with said coupling space and respectively pivotally coupled to said two metal pivot rods at said outer coupling end of said electrically insulative cylindrical base of said rotary connector, and two metal conductors embedded in said electrically insulative and substantially U-shaped base and respectively extended to said pivot holes and kept in positive contact with said two metal pivot rods of said rotary connector; and an electrical cable electrically connected to said two metal conductors.

2. The swivel cable connector mounting structure as claimed in claim 1, further comprising a spring member mounted around said electrically insulative cylindrical base of said rotary connector and said peripheral wall of said device housing, wherein said rotary connector further comprises an electrically insulative stop flange extending around the periphery of the inner end of said electrically insulative cylindrical base and stopped at one end of said spring member against an inner surface of said peripheral wall of said device housing, said electrically insulative stop flange having a greater diameter than said through hole.

3. The swivel cable connector mounting structure as claimed in claim 1, wherein said rotary connector further comprises two electrically insulative stop flanges extending around the periphery of said electrically insulative cylindrical base and respectively stopped at opposing inner and outer sides of said peripheral wall of said device housing, said electrically insulative stop flanges having a greater diameter than said through hole.

4. The swivel cable connector mounting structure as claimed in claim 1, wherein said outer coupling end of said electrically insulative cylindrical base of said rotary connector has a flat profile, exhibiting an elevational difference relative to said electrically insulative cylindrical base.

5. The swivel cable connector mounting structure as claimed in claim 1, wherein said two bottom arms each have a round end.

6. The swivel cable connector mounting structure as claimed in claim 1, wherein said swivel connector comprises a wire hole located on a top side of said electrically insulative and substantially U-shaped base in communication with said coupling space and extending in a parallel manner relative to the extending direction of said two bottom arms; said electrical cable is inserted through said wire hole and electrically connected to said two metal conductors.

7. The swivel cable connector mounting structure as claimed in claim 1, wherein said two metal conducting terminals are selectively made in the form of flat metal blades or round contact pins.

* * * * *